US005085714A

United States Patent [19]

Kitamura et al.

[11] Patent Number: 5,085,714

[45] Date of Patent: Feb. 4, 1992

[54] METHOD OF MANUFACTURING A STEEL SHEET

[75] Inventors: Mitsuru Kitamura; Shunichi Hashimoto, both of Kobe, Japan

[73] Assignee: Kabushiki Kaisha Kobe Seiko Sho, Kobe, Japan

[21] Appl. No.: 564,756

[22] Filed: Aug. 9, 1990

[30] Foreign Application Priority Data

| | | | |
|---|---|---|---|
| Aug. 9, 1989 | [JP] | Japan | 1-206305 |
| Sep. 5, 1989 | [JP] | Japan | 1-230873 |
| Nov. 2, 1989 | [JP] | Japan | 1-286853 |

[51] Int. Cl.[5] ..... C21D 8/04

[52] U.S. Cl. ..... 148/16.5; 148/16.6

[58] Field of Search ..... 148/16.5, 16.6, 12 D, 148/12 C, 12 F

[56] References Cited

U.S. PATENT DOCUMENTS

| | | | |
|---|---|---|---|
| 4,368,084 | 1/1983 | Irie et al. | 148/12 D |
| 4,979,997 | 12/1990 | Kobayashi et al. | 148/16.6 |

FOREIGN PATENT DOCUMENTS

| | | | |
|---|---|---|---|
| 57-51260 | 3/1982 | Japan | 148/16.5 |
| 61-13659 | 6/1986 | Japan | 148/12 D |
| 62-112729 | 5/1987 | Japan | 148/12 D |

*Primary Examiner*—Deborah Yee

*Attorney, Agent, or Firm*—Oblon, Spivak, McClelland, Maier & Neustadt

[57] ABSTRACT

A method of manufacturing steel sheets by applying continuous annealing after applying hot rolling or hot rolling and cold rolling by a customary method to steel material, containing less than 0.007% of C, less than 0.1% of Si, from 0.05 to 0.50% of Mn, less than 0.10% of P, less than 0.015% of S, from 0.005 to 0.05% of sol.Al and less than 0.006% of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\%) = \text{total } Ti(\%) - ((48/32) \times S(\%) + (48/14) \times N(\%)) \quad (1)$$

$$1 \leqq (Ti^*/48 + Nb/93)/(C/12) \leqq 4.5 \quad (2)$$

if necessary, further containing from 0.0001 to 0.0030% of B and the balance of Fe and inevitable impurities, wherein continuous carburization and/or nitriding is applied, simultaneously, with the annealing such that the amount of solid-solute C and/or the amount of solid-solute N in the steel sheet is from 2 to 30 ppm. Steel sheets having excellent resistance to the cold-work embrittlement or provided with the BH property can be produced without deteriorating properties required for steel sheets, in particular, formability.

12 Claims, 5 Drawing Sheets

(NOTE)

| | ANNEALING IN CARBURIZING GAS ATMOSPHERE | ANNEALING IN INERT GAS ATMOSPHERE |
|---|---|---|
| STEEL WITHOUT B | ○ | ● |
| STEEL WITH B | △ | ▲ |

(NOTE)

| | ANNEALING IN CARBURIZING GAS ATMOSPHERE | ANNEALING IN INERT GAS ATMOSPHERE |
|---|---|---|
| STEEL WITHOUT B | ○ | ● |
| STEEL WITH B | △ | ▲ |

(NOTE)

| | ANNEALING IN CARBURIZING GAS ATMOSPHERE | ANNEALING IN INERT GAS ATMOSPHERE |
|---|---|---|
| STEEL WITHOUT B | ○ | ● |
| STEEL WITH B | △ | ▲ |

(NOTE)

| | EXAMPLE | COMPARATIVE EXAMPLE |
|---|---|---|
| STEEL WITH-OUT B | ○ | ● |
| STEEL WITH B | △ | ▲ |

METHOD OF MANUFACTURING A STEEL SHEET

BACKGROUND OF THE INVENTION

1. Field of the Invention

The present invention concerns a method of manufacturing hot-rolled steel sheets, cold-rolled steel sheets, hot dip galvanized hot-rolled steel sheets, hot dip galvanized cold-rolled steel sheets, etc. and, in particular, it relates to a method of manufacturing various kinds of steel sheets as described having excellent resistance to cold-work embrittlement or provided with bake-hardening property (BH property).

2. Description of the Prior Art

Steel sheets used for automobile parts or outer panels of electric equipments have been required to be light in weight, free from rusting and having excellent cold workability in recent years.

For such requirements, component steels, a so-called IF (Interstitial Free) steels, in which carbo-nitride forming elements such as Ti or Nb are added alone or in combination to ultra-low carbon steels for stabilizing C and N in the steel have generally been used.

However, ultra-low carbon steels in which C and N in the steels are sufficiently stabilized by the addition of carbo-nitride forming elements such as Ti and/or Nb involve a problem that cracking due to brittle fracture occurs in the cold-work after press forming. This is attributable to that solid-solute C and N are not present in the steels and, accordingly, C and N are no more segregated into the grain boundary to weaken the grain boundary.

Further, P-added steels involve a problem that P is segregated to the grain boundary to promote brittleness or hot dip galvanized steels involve a problem that zinc intrudes into the grain boundary upon hot dip galvanizing treatment to further reduce the strength of the grain boundary. Furthermore, since the baking hardening (BH) property is obtained under the effect of solid-solute C and N in the steels, the property can not be provided in such IF steels.

It has, accordingly, attempted, for improving the resistance to cold-work embrittlement or providing the BH property, to melt the steels while previously controlling the addition amount of Ti and Nb such that solid-solute C and N in the steels may be left. In this method, however, even if component steels having residual solid-solute C and N can be prepared, remarkable reduction is inevitable for the press formability since the solid-solute C and N generally deteriorate the r-value and the ductility of the steels. That is, the press formability and the resistance to the cold-work embrittlement or the BH property can not be compatible with each other. Furthermore, such a slight amount of solid-solute C and N can not be left in the steels in view of the steel making technology.

In view of the above, although the proposals as described below have been made so far, it is difficult to attain both excellent press formability and the resistance to cold-work embrittlement or the BH property together.

For instance, there has been proposed a method of adding Ti and Nb to stabilize C in the steels applying carburization upon open coil annealing after cold rolling thereby forming a carburized layer at the surface of steel sheets with an aim of improving the resistance to cold-work embrittlement of steel sheets used for deep drawing (Japanese Patent Laid-Open Sho 563-38556). In this method, however, since carburization is applied upon batch annealing conducted over a long period of time, it involves problems that a steel sheet has a difference in the composition and the microstructure are in the direction of the sheet thickness, such as a carburized layer at high concentration (average amount of C: 0.02 to 0.10%) is formed only at the surface layer of the steel sheet and a difference is caused in the ferrite grain size between the surface layer and the central portion. Furthermore, such a batch annealing naturally has low productivity, as well as results in a disadvantage that the material tends to be inhomogenous in the direction of the length and width of the sheet.

Also, as a method of manufacturing a steel sheet for use in deep drawing by the addition of Ti and Nb, there has also been proposed a method of applying recrystallization annealing after cold rolling and then further applying carburization (Japanese Patent Laid-Open Hei 1-96330). However, this method intends to improve the strength mainly by the precipitation of a great amount of carbides or nitrides and no consideration is taken for the resistance to cold-work embrittlement and the BH property. In addition, since carburization is applied batch-wise for a long period of time after annealing, the amount of carburization tends to become excessive and inhomogenous, as well as the productivity is low and the steps are complicate.

OBJECT AND THE SUMMARY OF THE INVENTION

The present invention has been accomplished in order to overcome the foregoing problems in the prior art and it is an object of the invention to provide a method capable of manufacturing steel sheets of excellent resistance to cold-work embrittlement and provided with the excellent BH property at a good productivity while satisfying the requirements for the steel sheets, in particular, without deteriorating the formability.

In the foregoing proposals of the prior art, carburization was applied batch-wise, because the annealing time in a continuous annealing furnace or hot dip galvanizing line is about 90 sec at the longest and, accordingly, it is utterly impossible to intrude C and N into the central portion of the sheet thickness as apparent from the theoretical calculation based on the theory of determinative diffusion rate.

In view of the above, the present inventors have at first made a study on the reason for deteriorating the press-formability, in view of the fact that the production in the continuous annealing or hot dip galvanizing line in the prior art is theoretically impossible.

As a result, it has been found that the solid-solute C or N deteriorate the press formability because they give undesired effects on the local slipping system and the rearrangement of dislocation in the step of forming a gathered rolled structure and the step of forming a recrystallization texture, thereby hindering the development of (111) texture preferred for the deep drawing property.

In view of the above, the present inventors have made earnest studies on the method capable of dissolving such causes and, as a result, have establish an epoch-making technic of keeping the amount of the solid-solute C and N to be zero till the completion of recrystallization upon annealing at which the recrystallization texture is determined and then applying carburization or nitriding, thereby causing C and N atoms to remain at the grain boundary or in the grains at the final stage of products. In the thus prepared products, the press formability and the resistance to the cold-work embrittlement or the provision of the BH property are compatible with each other to obtain ideal steel sheets.

Specifically, the present invention provides a method of manufacturing steel sheets by applying continuous annealing after applying hot rolling by a customary method to steel material, containing less than 0.007% of C, (in the following, composition means wt %), less than 0.1% of Si, from 0.05 to 0.50% of Mn, less than 0.10% of P, less than 0.015% of S, from 0.005 to 0.05% of sol.Al and less than 0.006% of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\%) = \text{total } Ti(\%) - ((48/32) \times S(\%) + (48/14) \times N(\%)) \quad (1)$$

$$1 \leqq (Ti^*/48 + Nb/93)/(C/12) \leqq 4.5 \quad (2)$$

if necessary, further containing from 0.0001 to 0.0030% of B and the balance of Fe and inevitable impurities, wherein continuous carburization and/or nitriding is applied, simultaneously, with the annealing such that the amount of solid-solute C and/or the amount of solid-solute N in the steel sheet is from 2 to 30 ppm.

Further, another invention of the present application provides a method of manufacturing cold rolled steel sheets by applying continuous carburization and/or nitriding, simulatneously, with applying continuous annealing after applying hot rolling and cold rolling by a customary method for the steel materials having the foregoing chemical compositions, such that the amount of solid-solute C and/or the amount of solid-solute N in the steel sheet is from 2 to 30 ppm.

A further invention of the present application provides a method of manufacturing hot dip galvanized steel sheets by applying continuous carburization and/or nitriding, simultaneously, with applying annealing in a hot dip galvanizing line after applying hot rolling or hot rolling and cold rolling by a customary method for the steel materials having the foregoing chemical compositions, such that the amount of solid-solute C and/or the amount of solid-solute N in the steel sheet is from 2 to 30 ppm.

DETAILED DESCRIPTION OF THE INVENTION

In summary, it has been found according to the present invention that the technique, which was so far considered to be theoretically impossible as described above, can be conducted even in a short time annealing such as continuous annealing or hot dip galvanizing, by using IF steels while ensuring 2 to 5 ppm of C and/or N required for filling the defects of the grain boundary for obtaining the resistance to cold work embrittlement or causing 5 to 30 ppm of C and/or N to remain in the grain boundary or in the gains required for providing the BH property. The reason is that since C and N intrude not by means of the intra-granular diffusion but by means of the grain boundary diffusion at a rate faster by about 10 times than the former and, further, the diffusion rate is further increased in the IF steels of extremely high grain boundary purity, required amounts of solid-solute C and N can be secured at first in the grain boundary and then in the grains in the continuous annealing or annealing in the hot dip galvanizing line from the state prior to such annealing in which the solid-solute C and N are not present.

Description will at first be made to the reason for the definition of the chemical compositions of the steels according to the present invention. C:

As the content of C increases, addition amount of Ti and/or Nb for stabilizeing C is increased, which results in increased production cost. Further, the amount of precipitating TiC and/or NbC is increased to hinder the grain growth and deteriorate the r-value. Accordingly, lesser C content is desirable and the upper limit is defined as 0.007% (in the following, composition means wt %). From a view point of steel making technology, the lower limit for the C content is desirably defined to be 0.0005%. Si:

Si is added mainly for the deoxidation of molten steels. However, since excess addition may deteriorate the surface property, chemical treatment property or painting property, the content is defined to less than 0.1%. Mn:

Mn is added mainly with an aim of preventive hot shortness. However, the aimed effect can not be obtained if it is less than 0.05% and, on the other hand, the ductility is deteriorated if the addition amount is excessive. Then, the content is defined within a range from 0.05 to 0.50%. P:

P has an effect of increasing the strength of steels without deteriorating the r-value but since it is segregated to the grain boundary tending to cause cold-work embrittlement, the content is restricted to less than 0.10%. S:

Since S chemically bonds with Ti to form TiS, the amount of Ti required for stabilizing C and N is increased along with the increase of the S content. In addition, since it increases MnS series extended inclusions product to deteriorate the local ductility, the content is restricted to less than 0.015%. Al:

Al is added with an aim of deoxidation of molten steels. However, if the content is less than 0.005% as sol.Al, the aimed purpose can not be attained. On the other hand, if it exceeds 0.05%, deoxidating effect is saturated and $Al_2O_3$ inclusion is increased to deteriorate formability. Accordingly, the content is defined within a range from 0.005 to 0.05% as sol Al. N:

Since N chemically bonds with Ti to form TiN, the amount of Ti required for stabilizing C is increased along with the increased content of N. Further, the amount of precipitating TiN is increased to hinder the grain growth and deteriorate the r-value. Accordingly, lower N content is more desirable and it is restricted to less than 0.006%. Ti and Nb:

Ti and Nb have an effect of increasing the r-value by stabilizing C and N. In this case, since Ti chemically bonds with S and N to form TiS and TiN as described above, the amount of Ti in the final products has to be considered as an amount converted into an effective Ti amount (Ti*) calculated by the following equation (1):

$$*(\%) = \text{total } Ti(\%) - ((48/32) \times S(\%) + (48/14) \times N(\%)) \quad (1)$$

Accordingly, for attaining the purpose of the present invention, it is necessary that they are contained within such a range as capable of satisfying the equation (2)

regarding the relationship between the Ti* amount, Nb amount and C amount:

$$1 \leqq (Ti^*/48 + Nb/93)/(C/12) \leqq 4.5 \quad (2)$$

If the value for the equation (2) is smaller than 1, C and N can not be stabilized sufficiently to deteriorate the r-value. On the other hand, if the value exceeds 4.5, C and N intruding upon carburizing and nitriding treatments chemically bond with solid-solute Ti or Nb, failing to prevent the cold-work embrittlement or to provide the BH property, as well as the effect to increase r-value is saturated and it also leads to the increased cost. B:

B is an element effective for obtaining the resistance to cold-work embrittlement and it can be added as necessary. For obtaining the aimed effect, it has to be added at least by more than 0.0001%. however, if it exceeds 0.0030%, the effect is saturated and the r-value is deteriorated. Accordingly, the addition amount is defined within a range from a 0.0001 to 0.0030%.

The manufacturing method according to the present invention will now be explained.

Steels having the chemical compositions as described above can be fabricated into steel sheets by means of hot rolling or hot rolling and cold rolling by customary methods. There is no particular restrictions and manufacturing method capable of providing r-value and ductility aimed in the final products may be employed. That is, hot rolled steel sheets prepared by applying hot rolling directly or hot rolling after re-heating treatment in a usual step or without cooling slabs to lower than the $Ar_3$ point, or steel sheets prepared by further pickling and applying cold rolling for such hot rolled steel sheets are used as the starting sheets before annealing.

Referring more specifically to the conditions for the hot rolling and the cold rolling, the hot rolling can be applied at a finishing temperature within a range from $(Ar_3-50)$ to $(Ar_3+100)$°C. after heating the steels of the foregoing compositions at 1000° to 1250° C. This is applied since the refining of the grain size and random arranging of the texture by the hot rolling is necessary in view of the improvement for the r-value and the finishing temperature is not always necessary to be higher than the $Ar_3$ point. Accordingly, the range for the finishing temperature is defined as from $(Ar_3-50)$ to $(Ar_3+100)$°C.

The temperature for coiling after the hot rolling is desirably within a range from 400° to 800° C. in order to stabilize solid-solute C and N in the steels as carbonitrides.

Further, the cold rolling is desirably applied at a total reduction rate of 60 to 90% in order to develop the (111) texture, which is advantageous for the r-value.

Then, the starting sheets such as hot rolled steel sheets or cold rolled steel sheets are applied with continuous annealing or annealing in the hot dip galvanizing line at a temperature higher than the recrystallization temperature, in which the annealing is conducted continuously and, simultaneously, carburizing treatment and/or nitriding treatment is applied continuously in any either of the cases. However, for obtaining excellent resistance to cold work embrittlement and providing BH property, the treatment has to be applied under such conditions as to obtain from 2 to 30 ppm of solid-solute C and/or solid-solute N. If the amount is less than 2 ppm, the amount of C and N required for filling the defects in the grain boundary for obtaining the resistance to the cold-work embrittlement is insufficient. On the other hand, if it exceeds 30 ppm, workability such as elongation is deteriorated and sheet passing speed in the continuous annealing has to be lowered, to reduce the productivity. From 2 to 5 ppm of amount is preferred for obtaining excellent resistance to the cold-work embrittlement and 5 to 30 ppm of amount is preferred for providing the BH property.

The carburization treatment can be practiced by giving a carbon potential in a reducing atmosphere while mixing CO or lower hydrocarbon. The aimed carburization amount is controlled by selecting the combination of the carbon potential, annealing temperature and annealing time. The staying time in the continuous annealing furnace is preferably within a range from 2 sec to 2 min.

The nitriding treatment can be practiced by mixing $NH_3$ in a reducing atmosphere. The aimed nitriding amount is controlled by the combination of the $NH_3$ partial pressure, annealing temperature and annealing time. The staying time in the continuous annealing furnace is preferably within a range from 2 sec to 2 min.

For applying hot dip galvanizing to steel sheets, it is preferred to previously applying carburization and/or nitriding simultaneously with annealing in the hot dip galvanizing line and, subsequently, to cool them to a temperature from 400° to 550° C. at a cooling rate of higher than 3° C./s. If the cooling rate is lower than 3° C./s, the productivity is remarkably hindered. Further, it is preferred to cool the temperature for the sheets to 400°-550° C. which is substantially equal to that of the coating bath, since it is preferred in view of the adherance of the coating.

Overaging is not always necessary in the present invention but overaging may be conducted at 400°-550° C.

The thus cooled steel sheets are dipped into a hot zinc coating bath. If necessary, an alloying treatment may further be applied.

DESCRIPTION OF THE ACCOMPANYING DRAWINGS

FIG. 1 through FIG. 5 are graphs illustrating the characteristics of steel sheets obtained by examples, in which, FIG. 1 is a graph illustrating a relationship between $(Ti^*/48+Nb/93)/(C/12)$ and the r-value for cold rolled steel sheets with less than 0.015% of P-content added;

FIG. 2 is a graph illustrating a relationship between $(Ti^*/48+Nb/93)/(C/12)$ and the critical temperature for the cold-work embrittlement;

FIG. 3 is a graph illustrating the relationship between the content of P added and the critical temperature for the cold-work embrittlement in the P-added cold rolled steel sheets;

Figure 4:
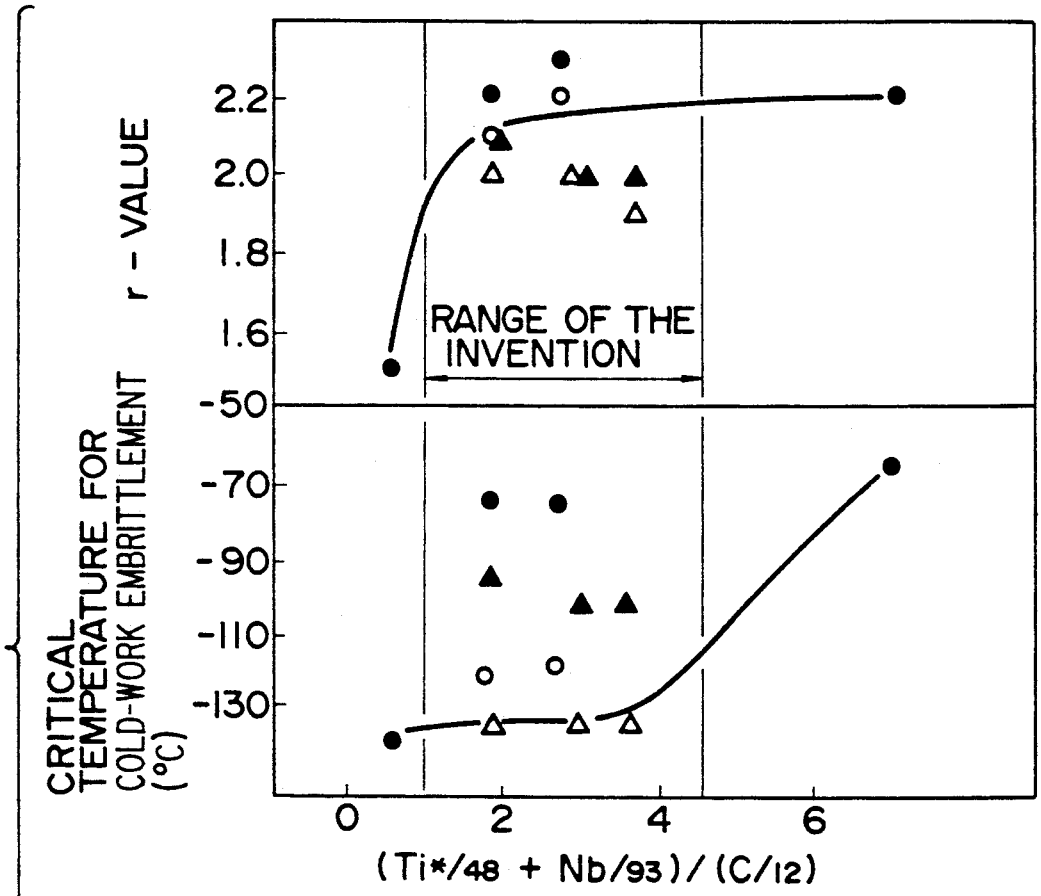
Figure 5:
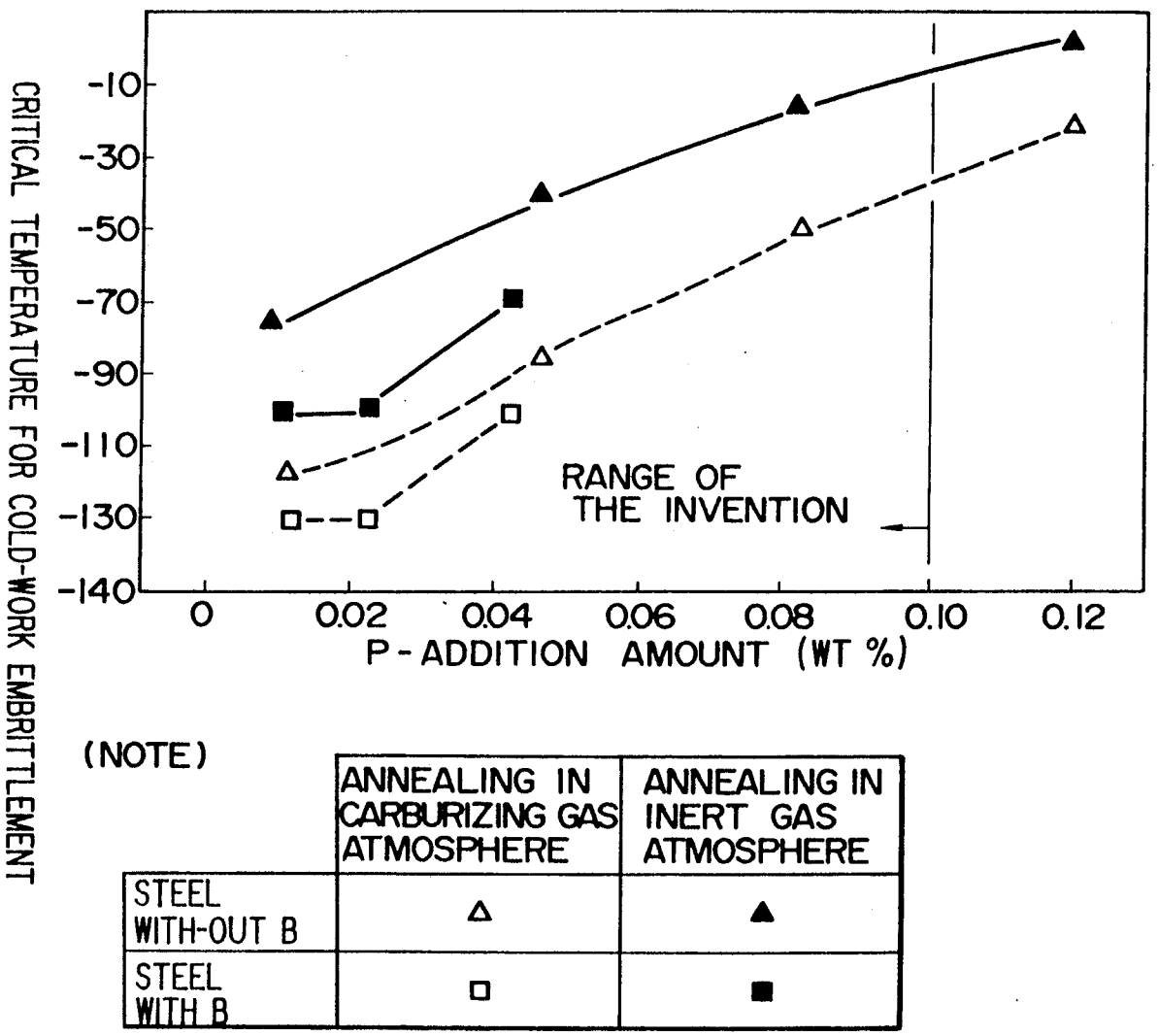

FIG. 4 is a graph illustrating a relationship between $(Ti^*/48+Nb/93)/(C/12)$, and the r-value and the critical temperature for the cold-work embrittlement in the cold rolled steel sheets with less than 0.025% of P-content added and applied with hot dip galvanized; and FIG. 5 is a graph illustrating a relationship between the P-content in the steel sheets mentioned just above and the critical temperature for the cold-work embrittlement.

EXAMPLE

The present invention will now be described referring to examples.

EXAMPLE 1

Steels No. 1 having chemical compositions shown in Table 1 were prepared by melting, heated to 1100° C., not lowering to less than the $Ar_3$ point, completed with hot rolling at a finishing temperature of 920° C., then coiled at 650° C., applied with pickling and then cold rolled at a reduction of 80% to obtain cold rolled steel sheet.

Then, the cold rolled steel sheets were applied with annealing in the following seven processes.

(1) Continuous annealing at 850° C.×50 sec in an atmosphere comprising CO/0.3%, $H_2$/5% and $N_2$/balance.

(2) Annealing at 850° C.×30 sec in an atmosphere comprising CO/0.3%, $H_2$/5% and $N_2$/balance, followed by passing through a hot dip galvanizing line of applying dipping after cooling at a rate of 5° C./sec to about 450° C.

(3) Continuous annealing at 850° C.×80 sec in an atmosphere comprising CO/0.7%, $H_2$/5% and $N_2$/balance.

(4) Annealing at 820° C.×65 sec in an atmosphere comprising CO/0.7%, $H_2$/5% and $N_2$/balance, followed by passing through a hot dip galvanizing line of applying dipping after cooling at a rate of 5° C./sec to about 450° C.

(5) Continuous annealing at 850° C.×90 sec in an atmosphere comprising $NH_3$/1%, $H_2$/5% and $N_2$/balance.

(6) Annealing at 830° C.×60 sec in an atmosphere comprising $NH_3$/1%, $H_2$/5% and $N_2$/balance, followed by passing through a hot dip galvanizing line of applying dipping after cooling at a rate of 5° C./sec to about 450° C.

(7) Continuous annealing at 850° C.×90 sec in an atmosphere comprising $H_2$/5% and $N_2$/95% (Comparative Example).

Table 2 shows the r-value, the critical temperature for the cold-work embrittlement and the BH amount of the products thus obtained.

In the brittle test, after trimming a cup obtained by cup forming at a total drawing ratio of 2.7 to 35 mm height, a conical punch with an appex of 40° was enforced to the cup in a cooling medium at each of test temperatures, to measure the critical temperature at which cracking did not occur and this was defined as the critical temperature for the cold-work embrittlement.

TABLE 1

| | Chemical compositions of tested steels (wt %) | | | | | | | | | | | |
|---|---|---|---|---|---|---|---|---|---|---|---|---|
| Steel No. | C | Si | Mn | P | S | Ti | Nb | B | sol. Al | N | Ti* | Value of equation (2) |
| 1 | 0.0025 | 0.05 | 0.15 | 0.019 | 0.0050 | 0.032 | — | — | 0.023 | 0.0030 | 0.0142 | 1.42 |
| 2 | 0.0020 | 0.03 | 0.12 | 0.015 | 0.0036 | 0.030 | — | — | 0.024 | 0.0029 | 0.0147 | 1.84 |
| 3 | 0.0030 | 0.06 | 0.18 | 0.012 | 0.0024 | 0.040 | — | — | 0.025 | 0.0027 | 0.0271 | 2.26 |
| 4 | 0.0024 | 0.02 | 0.21 | 0.011 | 0.0042 | — | 0.030 | — | 0.028 | 0.0032 | 0 | 1.61 |
| 5 | 0.0033 | 0.03 | 0.20 | 0.014 | 0.0061 | 0.040 | 0.020 | 0.0018 | 0.030 | 0.0023 | 0.0230 | 2.52 |

TABLE 2

| Annealing condition | r-value | critical temperature for cold-work embrittlement (°C.) | BH amount (kgf/mm²) | T.S. (kgf/mm²) | (Solid-solute C) Carburization amount (ppm) | (Solid-solute N) Nitriding amount (ppm) | Remarks |
|---|---|---|---|---|---|---|---|
| ① | 2.1 | −140 | 2.0 | 29.8 | 5 | — | Example |
| ② | 1.8 | −120 | 1.5 | 29.6 | 3 | — | " |
| ③ | 2.2 | −150 | 5.5 | 30.6 | 24 | — | " |
| ④ | 2.0 | −130 | 5.0 | 30.5 | 18 | — | " |
| ⑤ | 2.3 | −140 | 4.5 | 30.3 | — | 15 | " |
| ⑥ | 2.0 | −120 | 3.5 | 30.2 | — | 10 | " |
| ⑦ | 2.2 | −100 | 0.5 | 29.7 | — | — | Comparative Example |

EXAMPLE 2

Steels No. 2 having chemical compositions shown in Table 1 were prepared by melting, once cooled to a room temperature and then heated to 1150° C., completed with hot rolling at a finishing temperature of 900° C., coiled at 650° C., applied with pickling and then cold rolling at a reduction of 78% to obtain cold rolled steel sheets.

The r-value, critical temperature of the cold-work embrittlement and the BH amount of the after when the thus obtained cold rolled steel sheets were annealed under the conditions ((1)–(7)) shown in Example 1 are shown in Table 3.

EXAMPLE 3

Steels No. 3 having chemical compositions shown in Table 1 were prepared by melting to obtain the following four kinds of hot rolled steel sheets.

(a) Steels were heated at 1050° C. without lowering to less than the $Ar_3$ point, then completed with hot rolling at a finishing temperature of 900° C. and, subsequently, coiled at 580° C. (plate thickness: 2.0 mm).

(b) Steels were once cooled to a room temperature, then heated to 1150° C., completed with hot rolling at a finishing temperature of 880° C. and then coiled at 600° C. (plate thickness: 2.0 mm).

(c) Steels were once cooled to a room temperature, then heated to 1100° C., completed with hot rolling at a finishing temperature of 650° C. with no lubrication and, subsequently, coiled at 400° C. (plate thickness: 2.0 mm).

(d) Steels were once cooled to a room temperature, then heated to 1100° C., completed with hot rolling at a finishing temperature of 650° C. with lubrication and, subsequently, coiled at 400° C. (plate thickness: 2.0 mm).

The r-value, the elongation El, the critical temperature for the cold-work embrittlement and the BH amount for the products after annealing the resultant hot-rolled steel sheets under the conditions ((3), (4), (7)) shown in Example 1 are shown in Table 4.

EXAMPLE 4

Steels No. 4 having chemical compositions shown in Table 1 were prepared by melting, once cooled to a room temperature, then heated to 1200° C., completed with hot rolling at a finishing temperature of 920° C., coiled at 700° C., applied with pickling and then with cold rolling at a reduction of 75% to obtain cold rolled steel sheets.

The r-value, the critical temperature of the cold-work embrittlement and the BH amount of the products under the conditions ((1), (3), (5) and (7)) shown in Example 1 are shown in Table 5.

EXAMPLE 5

Steels No. 5 having chemical compositions shown in Table 1 were prepared by melting, once cooled to a room temperature, then heated to 1200° C., completed with hot rolling at a finishing temperature of 900° C., subsequently, coiled at 700° C., applied with pickling and then with cold rolling at a reduction of 75% to obtain cold rolled steel sheets.

The r-value, the critical temperature of the cold-work embrittlement and the BH amount of the products after annealing the thus obtained cold rolled steel sheets under the conditions ((2), (4), (6) and (7)) shown in Example 1 are shown in Table 6.

TABLE 3

| Annealing condition | r-value | Critical temperature for cold-work embrittlement (°C.) | BH amount (kgf/mm²) | T.S. (kgf/mm²) | (Solid-solute C) Carburization amount (ppm) | (Solid-solute N) Nitriding amount (ppm) | Remarks |
|---|---|---|---|---|---|---|---|
| 1 | 2.2 | −145 | 1.6 | 29.7 | 5 | — | Example |
| 2 | 1.9 | −120 | 1.5 | 29.6 | 4 | — | " |
| 3 | 2.4 | −150 | 5.4 | 30.4 | 22 | — | " |
| 4 | 2.2 | −140 | 4.8 | 30.2 | 16 | — | " |
| 5 | 2.4 | −140 | 4.3 | 30.3 | — | 14 | " |
| 6 | 2.3 | −120 | 3.2 | 30.1 | — | 10 | " |
| 7 | 2.4 | −95 | 0.4 | 29.4 | — | — | Comparative Example |

TABLE 4

| Hot rolling condition | Annealing condition | r-value | El (%) | Critical temperature for cold-work embrittlement (°C.) | BH amount (kgf/mm²) | T.S. (kgf/mm²) | (Solid-solute C) Carburization amount (ppm) | Remarks |
|---|---|---|---|---|---|---|---|---|
| (a) | 3 | 0.8 | 52 | −120 | 3.0 | 29.2 | 10 | Example |
| | 4 | 0.8 | 51 | −100 | 3.0 | 29.0 | 8 | " |
| | 7 | 0.8 | 52 | −60 | 0.5 | 28.8 | — | Comparative Example |
| (b) | 3 | 0.9 | 53 | −125 | 3.5 | 29.0 | 12 | Example |
| | 4 | 0.8 | 52 | −100 | 3.0 | 28.8 | 10 | " |
| | 7 | 0.8 | 50 | −55 | 0.0 | 28.5 | — | Comparative Example |
| (c) | 3 | 1.3 | 58 | −130 | 4.0 | 29.4 | 15 | Example |
| | 4 | 1.2 | 56 | −110 | 3.0 | 28.8 | 8 | " |
| | 7 | 1.4 | 58 | −85 | 0.0 | 28.6 | — | Comparative Example |
| (d) | 3 | 1.8 | 60 | −135 | 3.6 | 29.2 | 12 | Example |
| | 4 | 1.5 | 57 | −115 | 2.8 | 29.0 | 9 | " |
| | 7 | 1.8 | 59 | −65 | 0.0 | 28.4 | — | Comparative Example |

after annealing the thus obtained cold rolled steel sheets

TABLE 5

| Annealing condition | r-value | Critical temperature for cold-work embrittlement (°C.) | BH amount (kgf/mm²) | T.S. (kgf/mm²) | (Solid-solute C) Carburization amount (ppm) | (Solid-solute N) Nitriding amount (ppm) | Remarks |
|---|---|---|---|---|---|---|---|
| 1 | 2.1 | −130 | 2.2 | 31.2 | 6 | — | Example |
| 3 | 2.2 | −145 | 5.6 | 31.8 | 27 | — | " |
| 5 | 2.1 | −140 | 4.3 | 31.5 | — | 15 | " |
| 7 | 2.2 | −110 | 0.6 | 31.2 | — | — | Comparative Example |

TABLE 6

| Annealing condition | r-value | Critical temperature for cold-work embrittlement (°C.) | BH amount (kgf/mm²) | T.S. (kgf/mm²) | (Solid-solute C) Carburization amount (ppm) | (Solid-solute N) Nitriding amount (ppm) | Remarks |
|---|---|---|---|---|---|---|---|
| ② | 1.9 | −140 | 1.4 | 30.9 | 3 | — | Example |
| ④ | 2.1 | −150 | 5.0 | 31.6 | 22 | — | " |
| ⑥ | 2.2 | −140 | 3.0 | 31.3 | — | 8 | " |
| ⑦ | 2.3 | −120 | 0.2 | 31.0 | — | — | Comparative Example |

EXAMPLE 6

Test steels having the chemical compositions shown in Table 7 were applied with a solid solution treatment by being heated to 1250° C. for 30 min, completed with hot rolling at a finishing temperature of 900° C. and then coiled at 750° C.

Then, after pickling, the sheets were cold rolled at a reduction of 75%, applied with recrystallizing annealing at 850° C. for one min in a carburizing atmospheric gas and an inert gas as the continuous annealing, cooled at a cooling rate of about 70° C./s to 400° C., applied with overaging at that temperature for 3 min and with 1% skin pass.

Figure 1:
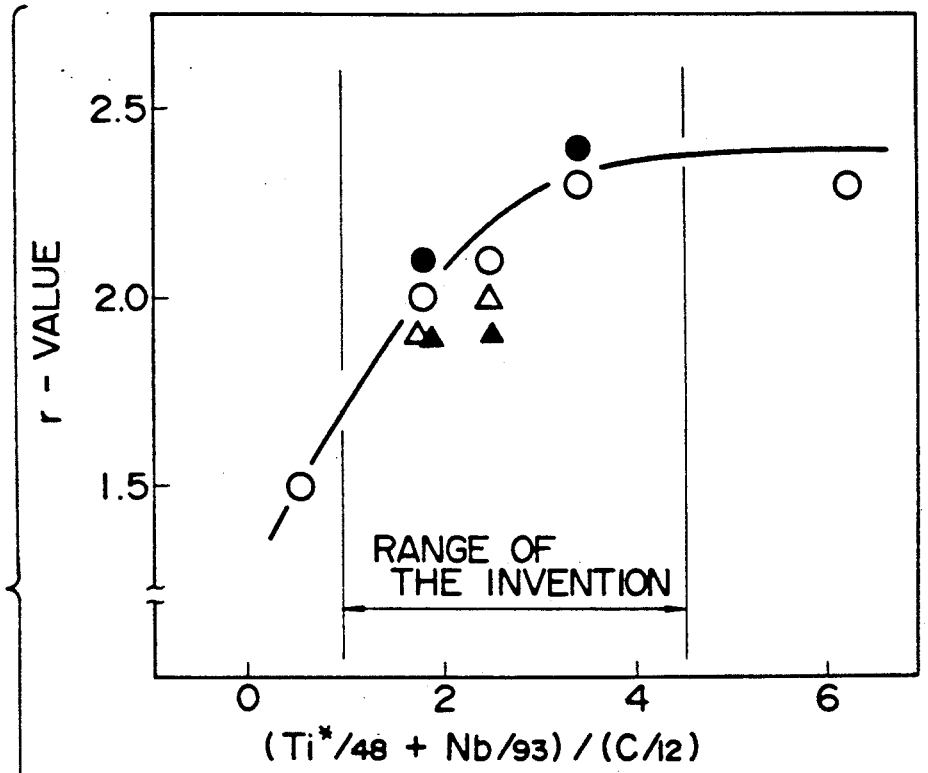
Figure 2:
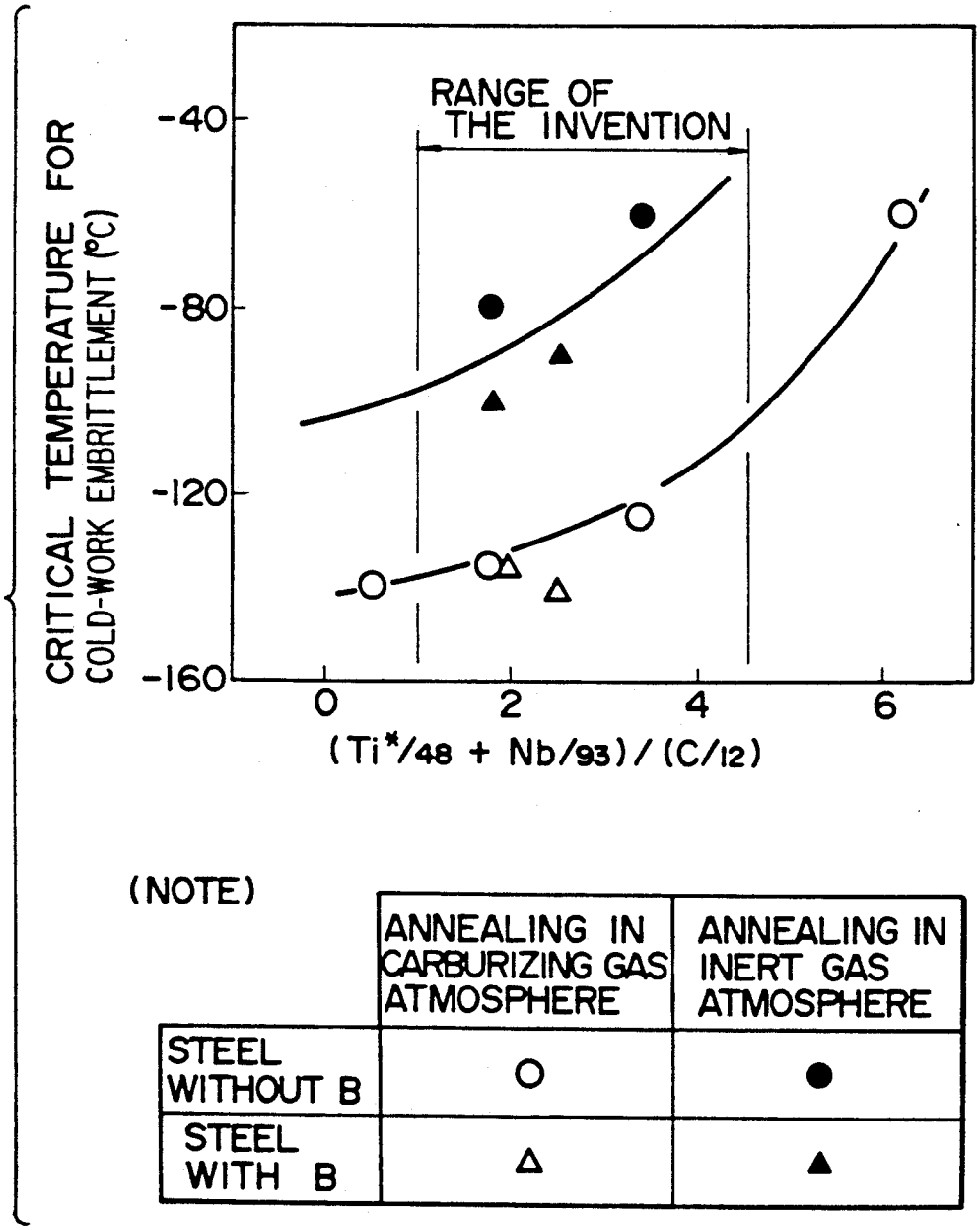
Figure 3:
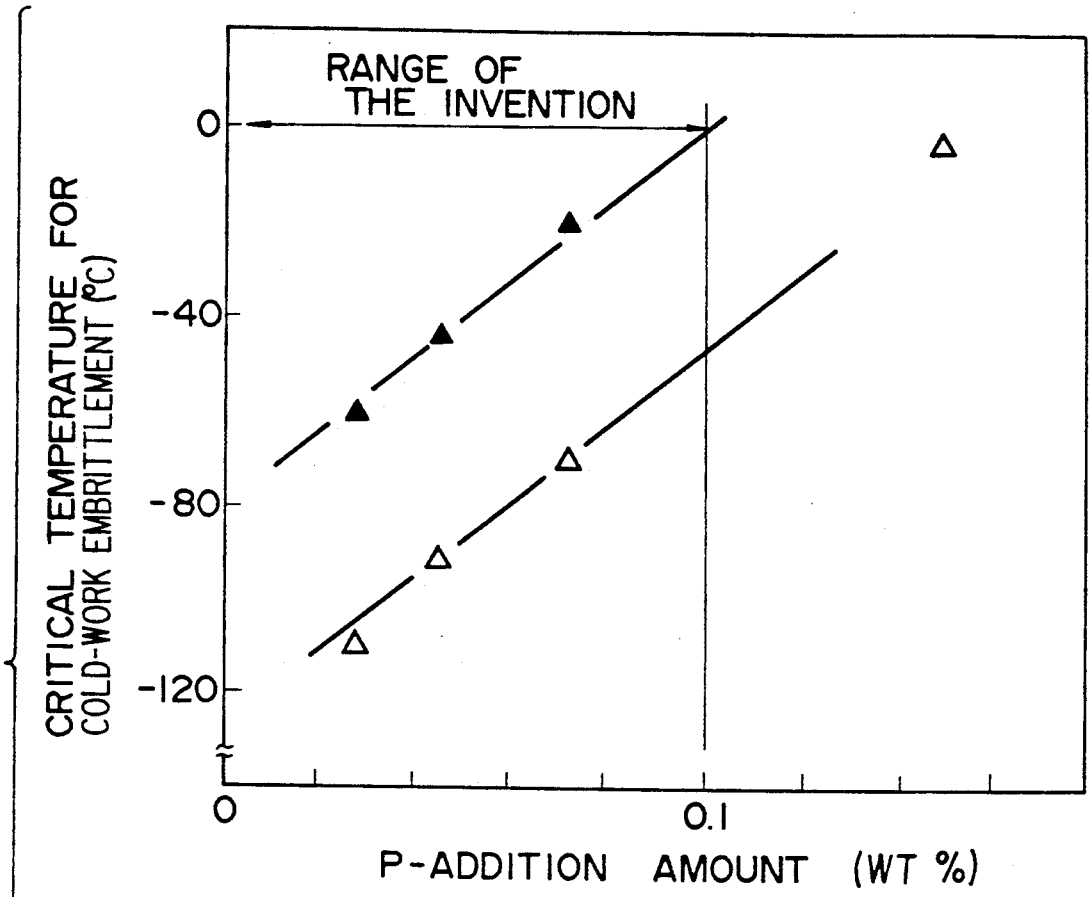

The mechanical property and the critical temperature for the cold-work embrittlement of the resultant cold rolled steel sheets are shown in Table 8 and several properties among them are re-arranged and shown in FIG. 1 through FIG. 3.

In the brittle test, after trimming a cup obtained by cup forming at a total drawing ratio of 2.7 to 35 mm height, a conical punch with an appex of 40° was enforced to the cup in a cooling medium at each of test temperatures, to measure the critical temperature at which cracking did not occur, which was defined as the critical temperature for the cold-work embrittlement.

As apparent from Table 8, in all of examples according to the present invention, the resistance to cold-work embrittlement can be improved without deteriorating the requirements as the cold rolled steel sheets for deep drawing.

On the other hand, steel sheets of comparative examples applied with continuous annealing in the inert gas were poor in the resistance to cold-work embrittlement, and those of other comparative examples applied with continuous annealing in a carburizing atmospheric gas were poor either in the press formability or in the resistance to the cold-work embrittlement since they contain chemical compositions out of the range of the present invention.

FIG. 1 shows a relationship between the value for (Ti*/48+Nb/93)/(C/12) and the r-value in the steels with the P-content added of less than 0.015%. It can be seen that the r-value is substantially saturated if the value for (Ti*/48+Nb/93)/(C/12) exceeds 4.5.

FIG. 2 shows a relationship between the value for (Ti*/48+Nb/93)/(C/12) and the critical temperature for the cold-work embrittlement in the same steels as those in FIG. 1. It can be seen that the critical temperature for the cold-work embrittlement is lowered by applying continuous annealing in the carburizing atmospheric gas for the steels having the chemical compositions within the range of the present invention.

FIG. 3 shows a relationship between the content of P add and the critical temperature for the cold-work embrittlement in the P-added steels. It can be seen that the critical temperature for the cold-work embrittlement is lowered by applying continuous annealing in the carburizing atmospheric gas for the steels having the P-content added within the range of the present invention.

TABLE 7

| | Chemical compositions of test steels (wt %) | | | | | | | | | | | |
|---|---|---|---|---|---|---|---|---|---|---|---|---|
| No. | C | Si | Mn | P | S | Ti | Nb | B | Al | N | X | Remarks |
| 1 | 0.0030 | <0.01 | 0.17 | 0.012 | 0.0081 | 0.031 | — | — | 0.028 | 0.0035 | 0.57 | Comparative Example |
| 2 | 0.0025 | <0.01 | 0.19 | 0.008 | 0.0061 | 0.037 | — | — | 0.024 | 0.0029 | 1.79 | Example |
| 3 | 0.0015 | <0.01 | 0.15 | 0.005 | 0.0040 | 0.042 | — | — | 0.031 | 0.0045 | 3.43 | " |
| 4 | 0.0042 | <0.01 | 0.31 | 0.011 | 0.010 | 0.130 | — | — | 0.029 | 0.0032 | 6.19 | Comparative Example |
| 5 | 0.0024 | <0.01 | 0.21 | 0.009 | 0.0056 | 0.035 | — | 0.0007 | 0.027 | 0.0028 | 1.74 | Example |
| 6 | 0.0038 | <0.01 | 0.24 | 0.014 | 0.0062 | 0.050 | 0.011 | 0.0018 | 0.037 | 0.0025 | 2.49 | " |
| 7 | 0.0033 | <0.01 | 0.18 | 0.028 | 0.0026 | 0.043 | — | — | 0.029 | 0.0031 | 2.16 | " |
| 8 | 0.0047 | <0.01 | 0.20 | 0.045 | 0.0060 | — | 0.050 | — | 0.038 | 0.0041 | 1.37 | " |
| 9 | 0.0025 | <0.01 | 0.22 | 0.072 | 0.0052 | — | 0.030 | — | 0.031 | 0.0025 | 1.55 | " |
| 10 | 0.0031 | <0.01 | 0.13 | 0.148 | 0.0049 | 0.036 | — | 0.0032 | 0.034 | 0.0030 | 1.47 | Comparative Example |

(Note)
$X = (Ti^*/48 + Nb/93)/(C/12)$ in which $Ti^* = Ti - \{(48/32) \times S) + (48/14) \times N\}$

TABLE 8

| Steel No. | Annealing atmosphere | TS (kgf/mm²) | YS (kgf/mm²) | El (%) | r-value | Critical temperature for cold-work embrittlement (°C.) | Remarks |
|---|---|---|---|---|---|---|---|
| 1 | Carburizing gas | 29.8 | 17.6 | 49.6 | 1.5 | −140 | Comparative Example |
| 2 | Inert gas | 29.7 | 14.1 | 48.8 | 2.1 | −80 | Comparative Example |

TABLE 8-continued

| Steel No. | Annealing atmosphere | TS (kgf/mm²) | YS (kgf/mm²) | El (%) | r-value | Critical temperature for cold-work embrittlement (°C.) | Remarks |
|---|---|---|---|---|---|---|---|
| | Carburizing gas | 30.1 | 15.6 | 47.9 | 2.0 | −135 | Example |
| 3 | Carburizing gas | 27.0 | 12.9 | 52.4 | 2.3 | −125 | Example |
| | Inert gas | 26.4 | 12.6 | 53.2 | 2.4 | −60 | Comparative Example |
| 4 | Carburizing gas | 30.3 | 14.5 | 48.9 | 2.3 | −60 | Comparative Example |
| 5 | Inert gas | 29.4 | 14.2 | 48.6 | 1.9 | −100 | Comparative Example |
| | Carburizing gas | 29.5 | 14.4 | 49.1 | 1.9 | −135 | Example |
| 6 | Inert gas | 30.3 | 14.7 | 47.5 | 2.0 | −90 | Comparative Example |
| | Carburizing gas | 30.5 | 14.6 | 47.2 | 1.9 | −140 | Example |
| 7 | Carburizing gas | 31.5 | 15.2 | 47.0 | 2.0 | −110 | Example |
| | Inert gas | 31.2 | 14.9 | 46.7 | 2.0 | −60 | Comparative Example |
| 8 | Inert gas | 33.8 | 17.1 | 44.8 | 1.9 | −45 | Comparative Example |
| | Carburizing gas | 34.0 | 17.4 | 44.5 | 1.8 | −95 | Example |
| 9 | Inert gas | 38.1 | 21.3 | 42.8 | 1.8 | −20 | Comparative Example |
| | Carburizing gas | 37.8 | 21.5 | 42.4 | 1.8 | −70 | Example |
| 10 | Carburizing gas | 42.6 | 28.1 | 39.3 | 1.7 | −5 | Comparative Example |

EXAMPLE 7

Ultra-low carbon steels having chemical compositions shown in Table 9 were applied with solid-solution treatment by being heated at 1150° C. for 30 min, completed with hot rolling at a finishing temperature of 890° C., subsequently, coiled at 720° C., applied with pickling and then cold rolling at a reduction of 75%. Then, the sheets were applied with re-crystallization annealing in a hot dip galvanizing line at 780° C. for 40 sec in a carburizing atmosphere or an inert gas, then applied with hot dip galvanizing at 450° C. and then 0.8% skin pass was further applied.

The mechanical property, the r-value and the critical temperature for the cold-work embrittlement were examined for the cold-rolled steel sheets applied with hot dip galvanizing thus obtained and the results are shown in Table 10.

In the brittle test, after trimming a cup obtained by cup forming at a total drawing ratio of 2.7 to 35 mm height, a conical punch with an appex of 40° was forced in a cooling medium at each of test temperatures to measure the critical temperature at which cracking did not occur, which was defined as the critical temperature for the cold-work embrittlement.

As apparent from Table 10, the products of the examples according to the present invention have excellent resistance to the cold-work embrittlement while maintaining press formability (r-value) as the cold rolled steel sheets applied with hot dip galvanizing for use in deep drawing as compared with comparative examples.

FIG. 4 shows a relationship between the value for (Ti*/48+Nb/93)/(C/12) and the r-value and the critical temperature for the cold-work embrittlement in the steels with less than 0.025% of P-content. It can be seen from the figure that the sheets of the examples of the present invention having the value for (Ti*/48+Nb/93)/(C/12) within the range of the present invention have high r-value and low critical temperature for the cold-work embrittlement.

Further, FIG. 5 shows a relationship between the P-content and the critical temperature for the cold-work embrittlement. It can be seen that although P is segregated in the grain boundary tending to cause cold-work embrittlement, the resistance to the cold-work embrittlement can be improved by incorporating a predetermined amount of solid-solute C by the carburization and, the resistance to the cold-work embrittlement can further be improved by the addition of B.

TABLE 9

| Steel No. | Chemical compositions in test steels (wt %) C | Si | Mn | P | S | Ti | Nb | B | sol. Al | N | Ti* | X | Remarks |
|---|---|---|---|---|---|---|---|---|---|---|---|---|---|
| 1 | 0.0016 | <0.08 | 0.18 | 0.012 | 0.0048 | 0.027 | — | — | 0.025 | 0.0024 | 0.0116 | 1.81 | Steel |
| 2 | 0.0029 | | 0.21 | 0.009 | 0.0038 | 0.050 | — | — | 0.030 | 0.0040 | 0.0306 | 2.64 | of the |
| 3 | 0.0024 | | 0.21 | 0.014 | 0.0039 | 0.035 | — | 0.0008 | 0.024 | 0.0033 | 0.0179 | 1.86 | Invention |
| 4 | 0.0018 | | 0.22 | 0.022 | 0.0046 | — | 0.040 | 0.0015 | 0.035 | 0.0021 | 0 | 2.87 | |
| 5 | 0.0025 | | 0.14 | 0.012 | 0.0032 | 0.038 | 0.024 | 0.0024 | 0.034 | 0.0028 | 0.0236 | 3.60 | |
| 6 | 0.0044 | | 0.19 | 0.046 | 0.0061 | 0.052 | — | — | 0.036 | 0.0028 | 0.0333 | 1.89 | |
| 7 | 0.0031 | | 0.18 | 0.042 | 0.0028 | 0.043 | — | 0.0021 | 0.031 | 0.0031 | 0.0282 | 2.27 | |
| 8 | 0.0027 | | 0.22 | 0.081 | 0.0053 | — | 0.036 | — | 0.029 | 0.0032 | 0 | 1.72 | |
| 9 | 0.0042 | | 0.20 | 0.016 | 0.0058 | — | 0.020 | — | 0.030 | 0.0036 | 0 | 0.61 | Comparative |
| 10 | 0.0021 | | 0.26 | 0.011 | 0.0068 | 0.080 | — | — | 0.027 | 0.0030 | 0.0596 | 7.09 | steel |

TABLE 9-continued

| Steel No. | C | Si | Mn | P | S | Ti | Nb | B | sol. Al | N | Ti* | X | Remarks |
|---|---|---|---|---|---|---|---|---|---|---|---|---|---|
| | Chemical compositions in test steels (wt %) | | | | | | | | | | | | |
| 11 | 0.0026 | | 0.17 | 0.120 | 0.0056 | 0.038 | — | — | 0.025 | 0.0030 | 0.0193 | 1.86 | |

(Note 1) Ti* = Ti − (48/32) × S − (48/14) × N (%)
(Note 2) X = (Ti*/48 + Nb/93)/(C/12)

TABLE 10

| Steel No. | Annealing atmosphere | TS (kgf/mm²) | YS (kgf/mm²) | El (%) | r-value | Critical temperature for cold-work embrittlement | Solid-solute C (ppm) | Remarks |
|---|---|---|---|---|---|---|---|---|
| 1 | Inert gas | 28.3 | 13.1 | 52.5 | 2.2 | −75 | — | Comparative Example |
| | Carburizing gas | 28.9 | 16.6 | 50.9 | 2.1 | −120 | 16 | Example |
| 2 | Carburizing gas | 29.7 | 15.8 | 51.4 | 2.2 | −115 | 13 | Example |
| | Inert gas | 29.8 | 12.9 | 53.2 | 2.3 | −75 | — | Comparative Example |
| 3 | Inert gas | 29.5 | 12.8 | 49.4 | 2.1 | −95 | — | Comparative Example |
| | Carburizing gas | 30.1 | 16.5 | 48.2 | 2.0 | −130 | 18 | Example |
| 4 | Inert gas | 30.6 | 14.7 | 48.5 | 2.0 | −100 | — | Comparative Example |
| | Carburizing gas | 31.0 | 17.1 | 48.0 | 2.0 | −130 | 10 | Example |
| 5 | Inert gas | 31.5 | 15.2 | 48.4 | 2.0 | −100 | — | Comparative Example |
| | Carburizing gas | 31.7 | 15.9 | 47.7 | 1.9 | −130 | 12 | Example |
| 6 | Inert gas | 34.6 | 17.1 | 44.6 | 1.9 | −40 | — | Comparative Example |
| | Carburizing gas | 35.4 | 18.3 | 43.8 | 1.8 | −85 | 12 | Example |
| 7 | Inert gas | 34.1 | 17.3 | 44.8 | 1.9 | −70 | — | Comparative Example |
| | Carburizing gas | 35.0 | 18.5 | 43.2 | 1.8 | −100 | 8 | Example |
| 8 | Inert gas | 38.8 | 21.0 | 42.1 | 1.8 | −15 | — | Comparative Example |
| | Carburizing gas | 39.2 | 21.5 | 42.0 | 1.7 | −50 | 9 | Example |
| 9 | Carburizing gas | 29.4 | 17.6 | 47.2 | 1.5 | −135 | 32 | Comparative Example |
| 10 | Carburizing gas | 30.8 | 13.9 | 49.3 | 2.2 | −65 | — | Comparative Example |
| 11 | Carburizing gas | 43.0 | 25.2 | 38.5 | 1.9 | −20 | 10 | Comparative Example |
| | Inert gas gas | 42.5 | 24.5 | 39.5 | 1.9 | −5 | — | Comparative Example |

As has been described above specifically according to the present invention, since IF steels are used and required amount of solid-solute C or N can be secured by continuous annealing or annealing in the hot dip galvanizing line, it is possible to obtain those steel sheets of excellent resistance to the cold-work embrittlement or provided with the BH property without deteriorating the properties required for the steel sheets, in particular, the formability, at higher productivity, as compared with the conventional methods.

What is claimed is:

1. A method of manufacturing steel sheets by applying continuous annealing after applying hot rolling by a customary method to steel material, containing less than 0.007 wt % of C, less than 0.1 wt % of Si, from 0.05 to 0.50 wt % of Mn, less than 0.10 wt % of P, less than 0.015 wt % of S, from 0.005 to 0.05 wt % of sol.Al and less than 0.006 wt % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(wt\ \%) = total\ Ti(wt\ \%) - ((48/32) \times S(wt\ \%) + (48/14) \times N(wt\ \%)) \quad (1)$$

$$1 \leqq (Ti^*/48 + Nb/93)/(C/12) \leqq 4.5 \quad (2)$$

and the balance of Fe and inevitable impurities, wherein continuous carburization and/or nitriding is applied, simultaneously, with the annealing such that the amount of solid-solute C and/or the amount of solid-solute N in the steel sheet is from 2 to 30 ppm.

2. A method as defined in claim 1, wherein the steels further contain from 0.0001 to 0.0030 wt % of B.

3. A method of manufacturing cold rolled steel sheets by applying hot rolling and cold rolling in a customary manner and then applying continuous annealing to steel material containing less than 0.007 wt. % of C, less than 0.1 wt. % of Si, from 0.05 to 0.50 wt. % of Mn, less than 0.10 wt. % of P, less than 0.015 wt. % of S, from 0.005 to 0.05 wt. % of sol.Al and less than 0.006 wt. % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\text{wt. }\%) = \text{total Ti}(\text{wt. }\%) - ((48/32) \times S(\text{wt. }\%) + (48/14) \times N(\text{wt. }\%)) \quad (1)$$

$$1 \leqq (Ti^*/48 + NB/93)/(C/12) \leqq 4.5 \quad (2)$$

and the balance of Fe and inevitable impurities, wherein continuous carburizing and/or nitriding treatment is applied, simultaneously, with said continuous annealing such that the amount or solid-solute C and/or the amount or solid-solute N in the steel sheets is from 2 to 30 ppm.

4. The method of claim 3, wherein the steel material further contains from 0.0001 to 0.0030 wt. % of B.

5. A method of manufacturing cold rolled steel sheets by heating steel material containing less than 0.007 wt. % of C, less than 0.1 wt. % of Si, from 0.05 to 0.50 wt. % of Mn, less than 0.10 wt. % of P, less than 0.015 wt. % of S, from 0.005 to 0.05 wt. % of sol.Al and less than 0.006 wt. % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\text{wt. }\%) = \text{total Ti}(\text{wt. }\%) - ((48/32) \times S(\text{wt. }\%) + (48/14) \times N(\text{wt. }\%) \quad (1)$$

$$1 \leqq (Ti^*/48 + Nb/93)/(C/12) \leqq 4.5 \quad (2)$$

and the balance of Fe and inevitable impurities, at a temperature range from 1000° to 1250° C., applying hot rolling to complete the rolling in a range from ($Ar_3-50$) to ($Ar_3+100$)°C., then coiling the sheets within a range from 400° to 800° C., applying pickling, and then cold rolling at a total reduction within a range from 60 to 90%, and then applying a continuous annealing in a carburizing atmospheric gas at a temperature higher than the recrystallization temperature.

6. The method of claim 5, wherein the steel material further contains from 0.0001 to 0.0030 wt. % of B.

7. A method of manufacturing hot dip galvanized steel sheets, by applying hot rolling or hot rolling and cold rolling in a customary method to steel material containing less than 0.007 wt. % of C, less than 0.1 wt. % of Si, from 0.05 to 0.50 wt. % of Mn, less than 0.10 wt. % of P, less than 0.015 wt. % of S, from 0.005 to 0.05 wt. % of sol.Al and less than 0.006 wt. % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\text{wt. }\%) = \text{total Ti}(\text{wt. }\%) - ((48/32) \times S(\text{wt. }\%) + (48/14) \times N(\text{wt. }\%) \quad (1)$$

$$1 \leqq (Ti^*/48 + Nb/93)/(C/12) \leqq 4.5 \quad (2)$$

and the balance of Fe and inevitable impurities, and then applying annealing in a hot dip galvanizing line, wherein continuous carburizing and/or nitriding treatment is applied, simultaneously, with said annealing such that the amount of the solid-solute C and/or the amount or solid-solute N in the steel sheets is from 2 to 30 ppm.

8. The method of claim 7, wherein the steel material further contains from 0.0001 to 0.0030 wt. % of B.

9. A method of manufacturing cold rolled steel sheets applied with a hot dip galvanizing by heating steel material containing less than 0.007 wt. % of C, less than 0.1 wt. % of Si, from 0.05 to 0.50 wt. % of Mn, less than 0.10 wt. % of P, less than 0.015 wt. % of S, from 0.005 to 0.05 wt. % of sol.Al and less than 0.006 wt. % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\text{wt. }\%) = \text{total Ti}(\text{wt. }\%) - ((48/32) \times S(\text{wt. }\%) + (48/14) \times N(\text{wt. }\%)) \quad (1)$$

$$1 \leqq (Ti^*/48 + Nb/93)/(C/12) \leqq 4.5 \quad (2)$$

and the balance of Fe and inevitable impurities, at a temperature range from 1000° to 1250° C., applying hot rolling to complete the rolling within a range from ($Ar_3-50$) to ($Ar_3+100$)°C., then coiling the sheets at a temperature within a range from 400° to 800° C., applying pickling and then cold rolling, heating in a carburizing atmospheric gas to a temperature higher than the recrystallization temperature to control the amount of solid-solute C from 2 to 30 ppm and, subsequently, applying continuous hot dip galvanizing.

10. The method of claim 9, wherein the steel material further contains from 0.0001 to 0.0030 wt. % of B.

11. A method of manufacturing cold rolled steel sheets applied with hot dip galvanizing by heating steel material containing less than 0.007 wt. % of C, less than 0.1 wt. % of Si, from 0.05 to 0.50 wt. % of Mn, less than 0.10 wt. % of P, less than 0.015 wt. % of S, from 0.005 to 0.05 wt. % of sol.Al and less than 0.006 wt. % of S, from 0.005 to 0.05 wt. % of sol.Al and less than 0.006 wt. % of N, further, containing Ti and/or Nb added solely or in combination within such a range that the relationship of the effective amount of Ti (referred to as Ti*) and the amount of Nb in accordance with the following formula (1) with the amount of C can satisfy the following formula (2):

$$Ti^*(\text{wt. }\%) = \text{total Ti}(\text{wt. }\%) - ((48/32) \times S(\text{wt. }\%) + (48/14) \times N(\text{wt. }\%)) \quad (1)$$

$$1 \leqq (Ti^*/48 + Nb/93)/(C/12) \leqq 4.5 \quad (2)$$

and the balance of Fe and inevitable impurities, at a temperature range from 1000° to 1250° C., applying hot rolling to complete the rolling within a range from ($Ar_3-50$) to ($Ar_3+100$)°C., then coiling the sheets at a temperature within a range from 400° to 800° C., applying pickling and then cold rolling, applying continuous annealing in a carburizing atmospheric gas to a temperature higher than the recrystallization temperature to control the amount or solid-solute C to 2–30 ppm, subsequently cooling them to a temperature from 400° to 550° C. at a cooling rate of higher than 3° C./s and , subsequently, applying hot dip galvanizing continuously.

12. The method of claim 11, wherein the steel material further contains from 0.0001 to 0.0030 wt. % of B.

* * * * *